United States Patent [19]

Hasker

[11] 4,163,169

[45] Jul. 31, 1979

[54] LOW-PRESSURE GAS DISCHARGE LAMP

[75] Inventor: Jan Hasker, Eindhoven, Netherlands

[73] Assignee: U.S. Philips Corporation, New York, N.Y.

[21] Appl. No.: 616,653

[22] Filed: Sep. 25, 1975

Related U.S. Application Data

[63] Continuation-in-part of Ser. No. 534,206, Dec. 19, 1974, abandoned.

[30] Foreign Application Priority Data

Jul. 11, 1974 [NL] Netherlands ..... 7409366

[51] Int. Cl.$^2$ ..... H01J 61/04

[52] U.S. Cl. ..... 313/203; 313/484

[58] Field of Search ..... 313/203, 484

[56] References Cited

FOREIGN PATENT DOCUMENTS 906948 6/1945 France .

1026044 1/1953 France ..... 313/203

*Primary Examiner*—Rudolph V. Rolinec

*Assistant Examiner*—Darwin R. Hostetter

*Attorney, Agent, or Firm*—Robert S. Smith

[57] ABSTRACT

A low-pressure gas discharge lamp in which thin-structured bodies are present in the discharge space for increasing the radiation output per unit volume.

16 Claims, 4 Drawing Figures

LOW-PRESSURE GAS DISCHARGE LAMP

This is a continuation-in-part of application Ser. No. 534,206, filed Dec. 19, 1974, now abandoned.

The invention relates to low-pressure gas discharge lamps.

In order to obtain more radiation from such lamps, it is known to increase the lamp power by increasing the lamp current. A detrimental result thereof is that when increasing the power to more than a given value more useful radiation is generated, but the conversion efficiency of the electrical energy supplied to the lamp into this useful radiation decreases. In addition the losses in a stabilizing element series-arranged with the lamp, for example, a choke or resistor increase when the current intensity increases.

A known method of inhibiting the above mentioned detrimental effect is to enlarge the surface of the wall, for example, by indentation as is described in U.S. Pat. No. 2,950,410. The drawback of these lamps is their complicated and consequently expensive manufacture, and moreover the improvement achieved is only little. Furthermore the light output decreases in the long run because dust may collect in the grooves on the outer side of the lamp.

Another embodiment is known from U.S. Pat. No. 3,290,538 in which a low-pressure mercury vapour discharge lamp is described which is provided with an inner tube. Also in this case the improvement in the increase of the light output in case of an increasing load is only little when it is compared with the same discharge lamp without an inner tube.

In a low-pressure gas discharge lamp according to the invention a solid state body having a structure permeable to the gas discharge is present in the space between the electrodes; this lamp is characterized in that the body is present over at least half the electrode distance and is thinly distributed over the discharge space, the ratio between the volume of the body and the volume of the discharge space being between $0.6\times10^{-7}f/\lambda$ and $0.6\times10^{-2}f/\lambda$ in which f represents the quotient of the volume and the area of said body in microns and $\lambda$ is an arbitrarily chosen number having the dimensions of microns equal to 1 micron.

It will be apparent that the significance of lambda in this equation is primarily for dimensional analysis and that it is a constant which does not vary from one lamp to another. This value of $\lambda$ will be understood hereafter in this application.

The electrode distance as used herein is understood to mean the distance between the electrodes measured along the axis of the discharge space. The discharge space as used herein is understood to be the product of the electrode distance and the average cross-sectional area of the lamp envelope intermediate the electrodes.

The effect of the presence of said body, which need not consist of one uninterrupted assembly, in the discharge space is that for the same current intensity through the lamp the lamp voltage can be considerably increased, while the detrimental effects which in the above-mentioned known lamps are accompanied by an increase of the lamp power due to an increase of the lamp current occur to a much lesser extent. This does not only apply to lamps according to the above referred to patent specifications but also to an even greater extent to normal lamps.

In addition, as compared with lamps without the body the losses at the electrodes and the losses in the stabilizing element are less at the same lamp power due to the lower lamp current required. This means that without an increase of the energy consumption by the lamp and the stabilizing element the light output per unit volume of the lamp can be considerably increased.

It is known from French Patent Specification No. 1,026,044 to provide bodies of, for example, glass or metal between the electrodes in a low-pressure mercury vapour discharge lamp having a luminescent wall so as to increase the light output per unit volume of the lamp. These bodies may have the shape of discs, tubes, helixes or may consist of glass wool.

Although the object of this French Patent Specification is to increase the light output per unit volume, as stated above, it is not stated which conditions, particularly the quantity and the distribution of the material of the bodies must be satisfied to realize this increase. In case of a too dense packing of the bodies no stable discharge can build up; on the other hand a too sparse packing there will be no noticeable effect.

There is of course a relationship between the area of the body and its shape. This relationship becomes manifest in the shape factor f denoting the relationship between the area and the volume of the body.

Eminent results are obtained when using a ratio between the volume of the body and the volume of the discharge space between $0.6\times10^{-6}f/\lambda$ and $0.6\times10^{-3}f/\lambda$.

It is not necessary that the body which has a thin or elongated structure be present over the entire distance between the electrodes in the discharge space; in order to obtain a regular distribution of radiation it is generally desirable for the body to be present over at least 80% of this distance.

If the above mentioned conditions are satisfied and if the material is substantially homogeneously distributed it is found that, independent of the material used, as an average per cubic mm of the volume of that part of the discharge space where the body is present a quantity of between $5\cdot10^{-6}$ mg and $5\cdot10^{-3}$ mg of the body is present.

In a preferred embodiment of a lamp according to the invention the electrode distance divided by the average diameter of the cross-section of the discharge space perpendicular to the discharge axis is greater than five. The process of producing radiation in the discharge space then proceeds in the most favourable way.

In another preferred embodiment of a lamp according to the invention the density of the thin-structured body near the longitudinal axis of the discharge space deviates from that near the wall. It may therefore be advantageous for a lamp according to the invention, to choose in the discharge space a smaller density of the thin-structured body near the longitudinal axis of the discharge space than near the wall. As a result the risk of an uneven temperature distribution on the wall is reduced; such an uneven temperature distribution gives rise to mercury deposits on the colder parts of the luminescent material in low-pressure mercury vapor discharge lamps, having a luminescent coating and to the formation of sodium mirrors on colder spots in low-pressure sodium vapour discharge lamps. On the other hand, to obtain a highest possible light output it may be advantageous, for example in the case of a circle-cylindrical discharge space to render the density of the thin-structured body near the longitudinal axis of the discharge space greater than near the wall.

A practical realization of a thin body in a lamp according to the invention may consist of filament wool, such as glass wool, for example, quartz glass wool or metal wool, for example tungsten wool. In a special embodiment of a lamp according to the invention the metal wool is provided with an electrical insulating material, so that a favourable potential distribution over the thin-structured body may be obtained. The average wire diameter is preferably chosen to be between 5 μm and 100 μm because a sufficiently thin structure is then obtained between the limits as mentioned above.

In a special embodiment of a discharge lamp according to the invention the thin-structured body may be luminescent, for example, it may consist of a luminescent glass or of glass coated with luminescent material such as manganese and/or antimony-activated calcium halophosphate.

The radiation output of a lamp according to the invention is very high if the thin-structured body has a low absorption for the useful radiation which may be both in the visible and in the ultraviolet part of the spectrum. This may be achieved when the material of the body is chosen to be such that this useful radiation is satisfactorily passed or reflected. If the material itself has a too strong absorption, a surface coating may be provided on which reflection may occur. This coating may consist of, for example, zirconium oxide, magnesium oxide, or barium sulfate.

Particularly in the case of small dimensions the temperature of the discharge space may reach such a value that the critical vapour pressure for the optimum conversion of electrical energy into useful radiation is exceeded. The conversion efficiency may in these cases be increased by using known means, for example, cooling of the entire lamp or part thereof, for example, by providing radiation shields on the electrode stems; another means to achieve this object is to provide an alloy regulating the vapour pressure in the discharge space. In a low-pressure mercury vapour discharge lamp the use of an amalgam of mercury and indium is possible.

The invention may be used for the most widely divergent types of low-pressure gas discharge lamps; typical examples are low-pressure sodium vapour discharge lamps and low-pressure mercury vapour discharge lamps provided or not provided with a luminescent coating.

Since the radiation output per unit volume is very large, lamps according to the invention can be very satisfactorily used for reproduction purposes. The lamps may then be formed, for example, as so-called aperture lamps through which a very strong directed beam of light is obtained. On the other hand it is possible to make very compact fluorescent lamps having a high light output from a small total volume.

It is of course desirable that the material of the body during manufacture and during the lifetime of the lamp is not disturbing. Consequently, materials are preferably chosen which emit as little gas as possible, which are not decomposed and cannot be attacked by the gas discharge. Since the gas discharge in a low-pressure sodium vapour discharge lamp is very agressive, it is desirable that the thin-structured body in such lamps is sodium resistant; particularly a body consisting of or coated with gehlenite glass is suitable for this purpose.

The invention will now be described with reference to a drawing and some examples.

Figure 1:
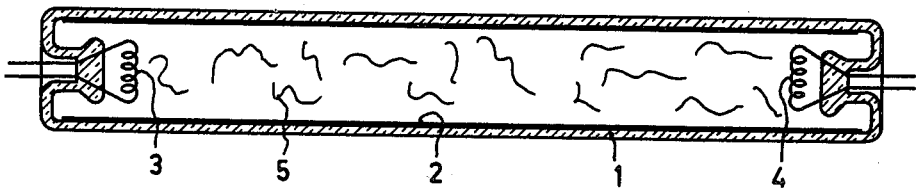
FIG. 1 is a diagrammatical cross-section of a low-pressure mercury vapour discharge lamp according to the invention, provided with a luminescent coating.

The lamp of FIG. 1 has a glass envelope 1 provided with a luminescent coating 2 which may consist of, for example, manganese and/or antimony-activated calcium halophosphate. The lamp is filled with mercury vapour and a rare gas or a combination of rare gases. Thermally emitting electrodes 3 and 4 are provided at the ends of the discharge space. The discharge space accommodates over substantially the entire space a body 5 consisting of thinly packed quartz glass wool.

Figure 2:
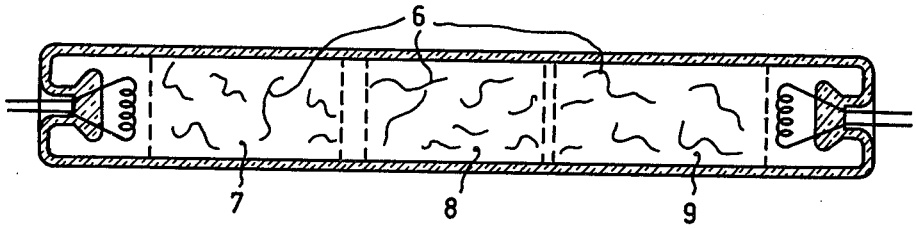
FIG. 2 shows an embodiment of a low-pressure mercury vapour discharge lamp for emitting ultraviolet radiation in which the filling body does not consist of one uninterrupted assembly.

The lamp in the embodiment according to FIG. 2, likewise as the lamp according to FIG. 1, contains thinly packed glass wool denoted by 6. The glass wool 6 does not constitute an uninterrupted body, but is distributed over three packets 7, 8 and 9. Between these packets and between the packets and the electrodes there are spaces not accommodating glass wool. The sum of the lengths of the packets measured along the discharge axis is larger than half the distance between the electrodes. More specifically the sum is approximately 88% of this distance.

Figure 3:
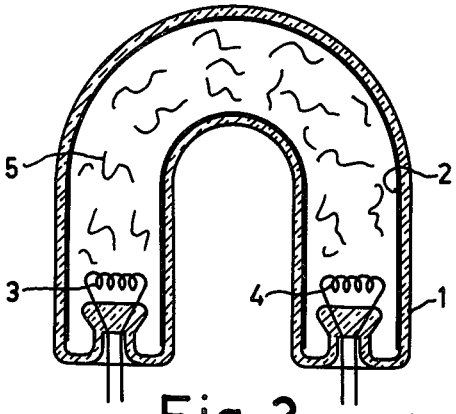
FIG. 3 shows a U-shaped curved embodiment of a low-pressure mercury vapour discharge lamp according to the invention.

FIG. 3 shows a modification of the lamp according to FIG. 1 in which the discharge tube is curved to a U-shape.

Figure 4:
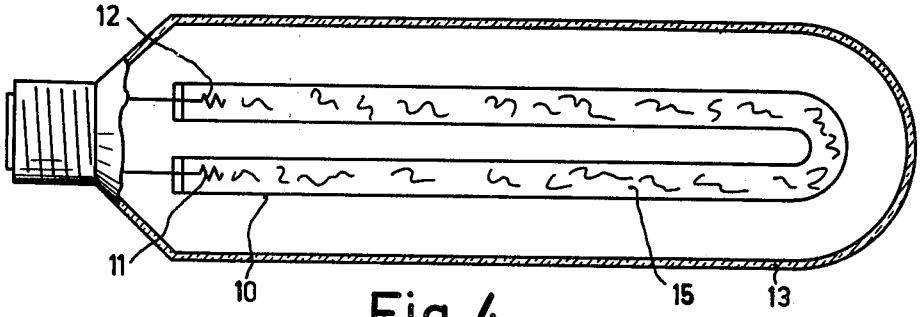
FIG. 4 shows an embodiment of a low-pressure sodium vapour discharge lamp according to the invention.

The lamp according to FIG. 4 has a U-shaped discharge tube 10 surrounded by an outer envelope 13. Thermally emitting electrodes 11 and 12 are provided at the ends of the discharge space. The discharge space accommodates over substantially its entire space a body 15 consisting of thinly packed gehlenite glass wool.

A number of measurements were performed on a 40 W low-pressure mercury vapour discharge lamp according to FIG. 1; the results are shown in table I. The lamp is filled with 58 mg of quartz wool having a thickness of 10 μm and comprises mercury and neon at a pressure of 1 torr.

TABLE I

| | |
|---|---|
| electrode distance (cm) | 55 |
| diameter (cm) | 3.6 |
| current intensity (mA) | 300 |
| light output (lumens) | 2520 |
| efficiency lamp (lumens/watt) | 63 |
| efficiency lamp + stabilizing element (lm/W) | 55 |

For the lamp there applies that the ratio between the volume of the body and the volume of the discharge space is $7\times10^{-5}f/\lambda$. As an average per cubic mm of the volume $10^{-4}$ mg is present.

A number of measurements were performed on a 40 W low pressure mercury vapour discharge lamp according to FIG. 1 and on a few lamps without a filling body 5 but having the same structure; the results for the different lamps are shown in Table II. In this Table the light output and the efficiency of a discharge lamp according to the invention filled with 140 mg of wool of glass having a composition in percentage by weight of: 68.7% of $SiO_2$; 2.95% of $B_2O_3$; 9.1% of $Na_2O$; 10.85% of $K_2O$; 6.85% of BaO; 1.5% of $Al_2O_3$ and 0.05% of SrO and having a thickness of 36μ are compared with the corresponding values of a discharge lamp without glass wool. Both lamps contain mercury and a mixture of 75% by volume of argon and 25% by volume of neon at a pressure of 2.5 torr.

TABLE II

| | with 140 mg glass wool | without glass wool |
|---|---|---|
| electrode distance (cm) | 55 | 55 |
| diameter (cm) | 3.6 | 3.6 |
| current intensity (mA) | 400 | 900 |
| light output (lumen) | 3000 | 2200 |
| light output per cubic cm | 5.4 | 3.9 |
| efficiency lamp (lm/w) | 75 | 55 |
| efficiency lamp + stabilizing element (lm/w) | 625 | 37 |

This Table shows that the light output per unit volume of a low-pressure mercury vapour discharge lamp according to the invention is larger than that of such a lamp without glass wool.

The Table also shows that the efficiency of the lamp has considerably increased. Furthermore it is found that the efficiency of the lamp in series with the required stabilizing element has increased by nearly 60%. This also resides in the fact that the current intensity has become considerably lower so that considerably fewer losses occur in the stabilizing element and on the electrodes.

The ratio between the volume of the body and the volume of the discharge space is $1.92\times10^{-5}f/\lambda$, for this lamp with $\lambda=1$. As an average per cubic mm of the volume $2.5\times10^{-4}$ mg is present.

Table III shows some measuring results of two similar 20 W low pressure mercury vapour discharge lamps with and without filling body 5. In this Table the light output and the efficiency of a discharge lamp according to the invention filled with 20 mg of quartz glass wool having a thickness of 10μ are compared with the corresponding values of a discharge lamp without quartz glass wool. Both lamps contain mercury and a mixture of 72% by volume of neon and 28% by volume of helium at a pressure of 6 torr.

TABLE III

| | with 20mg quartz glass wool | without quartz glass wool |
|---|---|---|
| electrode distance (cm) | 20 | 20 |
| diameter (cm) | 2.5 | 2.5 |
| operating voltage (volt) | 130 | 65 |
| current intensity (mA) | 200 | 400 |
| light output (lumen) | 960 | 580 |
| light output per cubic cm | 9.8 | 5.9 |
| efficiency lamp (lm/W) | 48 | 29 |
| efficiency lamp + stabilizing element (lm/w) | 40 | 20 |

This Table shows that the efficiency of the lamp in series with the required stabilizing element is doubled.

The ratio between the volume of the body and the volume of the discharge space is $0.3\times10^{-4}f/\lambda$. As an average per cubic mm of the volume $2\times10^{-4}$ mg is present.

In the case of a U-shape (see FIG. 3) a lamp is obtained having approximately the same dimensions as an incandescent lamp which requires a power of approximately 75 W for the same light output.

Table IV shows some measuring results of two similar 20 W low-pressure mercury vapour discharge lamps having a luminescent coating with and without filling body. The lamp according to the invention is filled with 96 mg of tungsten wool having a thickness of 15 μm. Both lamps contain mercury and a mixture of 72% by volume of neon and 28% by volume of helium at a pressure of 4 torr.

TABLE IV

| | with 96 mg tungsten wool | without tungsten wool |
|---|---|---|
| electrode distance (cm) | 20 | 20 |
| diameter (cm) | 2.5 | 2.5 |
| operating voltage (volt) | 120 | 65 |
| current intensity (mA) | 200 | 400 |
| light output (lumens) | 600 | 580 |
| light output per cubic cm | 6.1 | 5.9 |
| efficiency lamp (lm/W) | 30 | 29 |
| efficiency lamp + stabilizing element (lm/W) | 25 | 20 |

This Table shows that the efficiency of the lamp with tungsten wool in series with the required stabilizing element is 25% higher.

The ratio between the volume of the body and the volume of the discharge space is $6.6\times10^{-5}f/\lambda$ for this lamp; as an average per cubic mm of the volume $9.8\times10^{-4}$ mg is present.

Table V shows some measuring results for a low-pressure sodium vapour discharge lamp according to the invention (see FIG. 4) having a power of 35 W in a U-shaped discharge tube within an outer envelope. 110 mg of gehlenite glass wool resistant to the action of sodium (see United Kingdom patent specification No. 1,204,670) having a thickness of 15 μm is present in the discharge space. The results are compared with a low-pressure sodium vapour discharge lamp without a filling body, but of the same structure.

TABLE V

| | with 110 mg gehlenite glass wool | without gehlenite glass wool |
|---|---|---|
| electrode distance (cm) | 43 | 43 |
| diameter (cm) | 1.50 | 1.50 |
| operating voltage (volt) | 149 | 70 |
| current intensity (mA) | 300 | 600 |
| light output (lumens) | 5250 | 4450 |
| light output per cubic cm | 70 | 59 |
| efficiency lamp (lm/W) | 150 | 127 |
| efficiency lamp + stabilizing element (lm/Watt) | 107 | 78 |

This Table shows that the light output per unit volume of a low-pressure sodium vapour discharge lamp according to the invention is larger than of such a lamp with the same power, but without gehlenite wool.

The Table also shows that the efficiency of the lamp has increased. Furthermore the efficiency of the lamp in series with the required stabilizing element is found to have improved by 37%. This also resides in the fact that the current intensity has become considerably lower.

The ratio between the volume of the body and the volume of the discharge space is $7.6\times10^{-4}f/\lambda$ for this lamp. As an average per cubic mm $1.25\times10^{-3}$ mg is present.

The lamps provided with a thin-structured body whose data are shown in the Tables I to V are provided with the thermionic electrodes which are commonly used for low pressure mercury vapour discharge lamps and for low pressure sodium vapour discharge lamps. A favourable ratio can then be obtained in a simple manner between the useful electric power supplied to the lamp and the losses in the power supply apparatus when the ratio $V/1<7$ where V is the operating voltage in volts and 1 the electrode distance in centimeters.

We claim:

1. A low-pressure gas discharge lamp which comprises: an envelope, two spaced electrodes, and a solid state body having a plurality of elements which comprise a structure permeable to the discharge between said electrodes, said body extending over at least half the electrode distance and being thinly distributed over the discharge space, with oblique orientation of each of said plurality of elements to each of the rest of said plurality of elements of said body, the ratio between the volume of the body and the volume of the discharge space being between $0.6\times10^{-6}$ f/lambda and $0.6\times10^{-3}$ f/lambda where f represents the quotient of the volume and the area of said body in microns and lambda is a constant equal to 1 micron, said electrode distance divided by the average diameter of the cross-section of the discharge space perpendicular to the discharge axis being greater than five, said volume of said body being the sum of the volumes of all of said elements in said body, said area of said body being the sum of the area of all said elements of said body, said body being present over at least 80% of the electrode distance, and wherein as an average each cubic mm of the volume of the discharge space has disposed therein between $5\times10^{-6}$ mg and $5\times10^{-3}$ mg of the body.

2. A low pressure gas discharge lamp as claimed in claim 1 wherein the density of the body near the longitudinal axis of the discharge space deviates from that near the wall.

3. A low pressure gas discharge lamp as claimed in claim 1 wherein said body consists of filament wool.

4. A low pressure gas discharge lamp as claimed in claim 3 wherein the average diameter of the material of the body is between 5 μm and 100 μm.

5. A low pressure gas discharge lamp as claimed in claim 3 wherein said body consists of glass wool.

6. A low pressure gas discharge lamp as claimed in claim 3 wherein said body consists of quartz glass wool.

7. A low pressure gas discharge lamp as claimed in claim 3 wherein said body consists of metal wool.

8. A low pressure gas discharge lamp as claimed in claim 7 wherein said body consists of tungsten wool.

9. A low pressure gas discharge lamp as claimed in claim 7 wherein said body is provided with a jacket of electrical insulating material.

10. A low pressure gas discharge lamp as claimed in claim 1 wherein said body is thin-structured and has a low absorption for the useful radiation.

11. A low pressure gas discharge lamp as claimed in claim 1 wherein said body is provided with a coating reflecting useful radiation.

12. A low pressure gas discharge lamp as claimed in claim 1 further including means for obtaining the optimum vapour pressure for conversion of electrical energy into useful radiation.

13. A low-pressure gas discharge lamp as claimed in claim 12 wherein said means comprises an alloy regulating the vapour pressure and which is disposed in the discharge space.

14. A low pressure gas discharge lamp with thermionic electrodes as claimed in claim 1 wherein $V/1<7$, where V is the operating voltage in volts and 1 the electrode distance in centimeters.

15. A low pressure gas discharge lamp as claimed in claim 1 wherein said body is thin-structured and luminescent.

16. A low pressure gas discharge lamp as claimed in claim 1 wherein said body consists of gehlenite glass wool.

* * * * *